US005765746A

United States Patent [19]

Peasley et al.

[11] Patent Number: 5,765,746

[45] Date of Patent: Jun. 16, 1998

[54] RESTRICTED ORIENTATION SHIPPING CARTON BLANK

[75] Inventors: Richard A. Peasley, Elk Point; Roger D. Schlapia, North Sioux City; Paul R. Kayl, McCook Lake, all of S. Dak.; Matthew R. Merk, Sioux City, Iowa

[73] Assignee: Gateway 2000, Inc., North Sioux City, S. Dak.

[21] Appl. No.: 666,637

[22] Filed: Jun. 18, 1996

[51] Int. Cl.[6] ..... B65D 5/00; B65D 21/00

[52] U.S. Cl. ..... 229/104; 206/320; 206/509; 229/915.1

[58] Field of Search ..... 206/503, 508, 206/509, 320, 521, 8; 229/915, 915.1, 104

[56] References Cited

U.S. PATENT DOCUMENTS

| | | | |
|---|---|---|---|
| 1,891,334 | 12/1932 | Overton | 206/8 |
| 2,919,800 | 1/1960 | Jarund | 206/499 X |
| 3,465,946 | 9/1969 | Johnson . | |
| 4,283,001 | 8/1981 | Meyers . | |
| 4,437,570 | 3/1984 | Sorenson . | |
| 4,445,613 | 5/1984 | Cassidy . | |
| 4,582,198 | 4/1986 | Ditton | 206/508 X |
| 4,778,392 | 10/1988 | Mitchell | 229/915 X |
| 5,137,146 | 8/1992 | Stonehouse | 206/509 X |
| 5,226,543 | 7/1993 | Foos et al. | 206/320 X |
| 5,259,505 | 11/1993 | Sobel . | |
| 5,263,582 | 11/1993 | Schaaf . | |
| 5,385,232 | 1/1995 | Foos et al. . | |
| 5,385,293 | 1/1995 | Hirota et al. | 206/320 X |

*Primary Examiner*—Bryon P. Gehman
*Attorney, Agent, or Firm*—Schwegman, Lundberg, Woessner & Kluth, P.A.

[57] ABSTRACT

A shipping container which inhibits improper orientation by its shape and also provides protection for its contents. The container has a number of side panels, a top end and a bottom end. A top closure covers the top end and a bottom closure covers the bottom end. The top closure projects above the top end to a preselected height and by it shape inhibits placing the container on the top closure. The bottom closure is recessed within the container to a depth at least as deep as the height of the top closure so that a plurality of containers may be nested together. The container may also include a crush resistant structure as an integral part of the top closure or a separate insert. The structure has outer walls and inner load-bearing walls which inhibit the structure from collapsing when a compressive force is applied.

4 Claims, 9 Drawing Sheets

RESTRICTED ORIENTATION SHIPPING CARTON BLANK

FIELD OF THE INVENTION

The present invention relates to a container for shipping and storing objects which should not be shipped or stored in certain orientations, and more specifically to a container which by its shape inhibits the container being set on one of its sides.

BACKGROUND OF THE INVENTION

Many products in the marketplace have characteristics which will cause the product to malfunction or fail if it is shipped in a particular orientation. One type of product having such characteristics is a computer monitor or a television. Computer monitors and televisions incorporate what is known as cathode ray tube (CRT) technology in order to display an image on a screen. CRT monitors and televisions should not be shipped or stored with the screen facing downward. This is because any contamination in the CRT may fall onto the fluorescent screen which may harm its function and performance.

Computer monitors and televisions are typically shipped in large corrugated paperboard containers of a generally rectangular shape. In order to deter placement of the containers such that the monitor or television screen is facing downward, the containers are usually marked with words or graphic images on the outer surface. Such images usually include the words "THIS SIDE UP" and/or large conspicuous arrows indicating which side of the box should be placed facing upward. Individuals who handle the containers must pay close attention in order to avoid placing the containers with the monitor or television screen facing downward. Individuals who continuously handle numerous containers each day may easily be distracted or momentarily lose concentration and mis-orient a container.

Another problem in shipping computer monitors and televisions is that physical damage may occur to the screens of the units. A conventional shipping container for such products is designed to inhibit damage to the product by being substantially oversized relative to the computer monitor or television product contained within. Inclusion of a number of styrofoam or paperboard inserts is also common for use in retaining the monitor or television within the container spaced from any particular side of the container. To protect the screens, a large gap is usually left between the outside surface of the screen and the adjacent wall of the container.

Today, manufacturing cost reduction and quality are both essential in remaining competitive in markets such as the manufacture and sale of computer monitors and televisions. One problem with the prior art shipping containers is that since they are oversized, the containers take up a lot of unnecessary shipping space. Fewer products may be shipped per cubic volume of shipping space because of the oversized containers. If smaller containers were available, the cost of shipping computer monitors and televisions could be reduced significantly by increasing the number of units per cubic volume of shipping space required. A competing concern, however, is the quality of product available to the end consumer. It is important to provide undamaged, defect-free products to the end consumers.

What is needed is an improved shipping container which inherently deters improper orientation of the container by its shape. What is also needed is a shipping container which readily nests with adjacent shipping containers in order to minimize the amount of space necessary to ship a plurality of the shipping containers. What is also needed is a shipping container that is particularly useful in shipping computer monitors, televisions and the like. What is still further needed is a shipping container which is smaller relative to conventional computer monitor and television shipping containers and yet provides equivalent or improved protection for the screens of the product.

SUMMARY OF THE INVENTION

The present invention teaches a shipping container which helps protect an article held within and also to inhibit placement of the container in a particular orientation. In one embodiment, the shipping container of the invention has four side panels, a top end and a bottom end. A top closure covers the top end and a bottom closure covers the bottom end. The top closure projects above the top end to a preselected height and inhibits placement of the container on the projecting surface. The bottom closure is recessed within the container to a depth at least as large as the height of the projecting top closure. The bottom closure is intended to receive therein and nest with an adjacent top closure to save space when storing or shipping a number of containers.

In another embodiment, the shipping container has four side panels, a top end and a bottom end. The bottom end is covered by a bottom closure which has a different shape and contour than a top closure covering the top end. The bottom closure is essentially planar and recessed within the bottom end of the container. The top closure projects above the top end to a preselected height. The bottom closure is recessed within the container to a depth at least as deep as the height of the projecting top end, again to facilitate nesting of a number of containers.

In yet another embodiment, the shipping container again has four side panels, a top end and a bottom end. The top end is covered by a top closure that includes a crush resistant structure. The structure may be either formed integrally as part of the top closure or may be formed separately and added as an insert to the container. The structure generally has a pair of outer walls converging toward one another from either a base member or two side panels of the container. The structure also includes two depending walls, one from each outer wall and each joined to a load-bearing wall. Each load-bearing wall is joined to a foot member which extend away from one another. The foot members abut against either the base member of the separate structure or inner flaps of the top closure of the container. The foot members have free edges which push into closed ends defined by the outer walls and the adjoining container side panels or base member of the structure.

According to one aspect of the present invention, the shipping container inherently inhibits improper orientation of the container by its shape. According to another aspect of the present invention, the shipping container readily nests with adjacent shipping containers which minimizes the amount of space taken up by a plurality of containers when shipped or stored. According to yet another aspect of the present invention, the shipping container is particularly useful for shipping computer monitors, televisions and the like. According to still another aspect of the present invention, the shipping containers are smaller than typical computer monitor or television containers and yet provide equivalent or improved protection for the products held therein.

DESCRIPTION OF THE PREFERRED EMBODIMENT

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
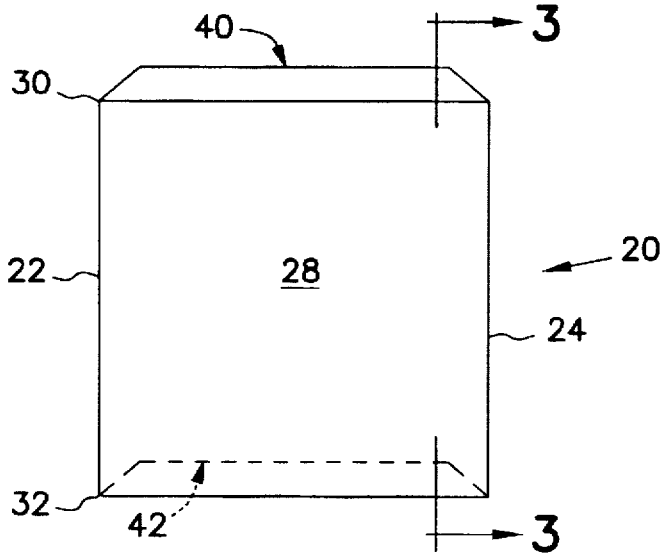
FIG. 1 is a side plan view illustrating a shipping container constructed in accordance with one embodiment of the present invention.
Figure 2:
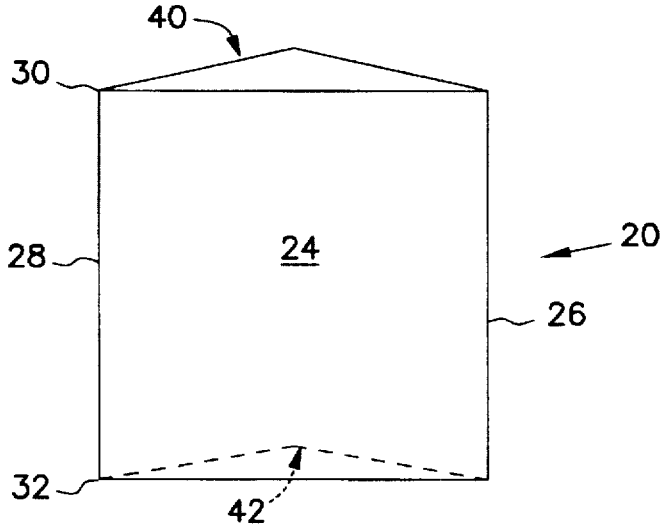
FIG. 2 is a side plan view illustrating the shipping container of FIG. 1 rotated 90° about its vertical axis.

Referring now to the drawings, FIGS. 1 and 2 illustrate one embodiment of a shipping container 20 constructed in accordance with the present invention. Container 20 is provided having at least one surface that is not planar that projects outward from the container so that the container cannot be set on that particular side on a flat surface. Container 20 is intended to be used for shipping and storing articles which may become damaged or destroyed if the storage container which houses them is placed on a particular side. Shipping container 20 of the present invention is particularly useful for computer monitors and televisions or the like. Monitors and televisions should not be shipped with the fluorescent screens facing downward. Contamination from the cathode ray tube (CRT) may fall onto the fluorescent screen if the articles are shipped with the screen face down, causing damage or functional problems.

In one embodiment, shipping container 20 includes a first pair of opposed side panels 22 and 24 and a second pair of opposed side panels 26 and 28. Side panels 22 and 24 are essentially parallel and spaced apart from one another and similarly, side panels 26 and 28 are essentially parallel and spaced apart from one another. The side panels are preferably of a rectangular configuration wherein the first pair of opposed panels 22, 24 are the same size and shape relative to one another, as are the second pair of opposed side panels 26, 28 relative to one another. Panels 22, 24, 26 and 28 are also attached to one another along parallel edges so that opposed side panels 22 and 24 are perpendicular to opposed side panels 26 and 28 such that the combination of panels forms a rectangular tube having a top end 30 and a bottom end 32 opposite the top end.

A top closure 40 is attached to and covers top end 30 and a bottom closure 42 is attached to and covers bottom end 32. Top closure 40 preferably projects outwardly from top end 30 creating a non-planar surface which will inhibit someone from placing the box on the top end. Bottom closure 42 of the present embodiment is recessed within bottom end 32 to a depth sufficient to receive therein a top closure of an adjacent shipping container. Such a construction permits a plurality of shipping containers 20 to be tightly packaged within a transport vehicle or storage facility without using excess space to accommodate the projecting top closures 40.

Figure 3:
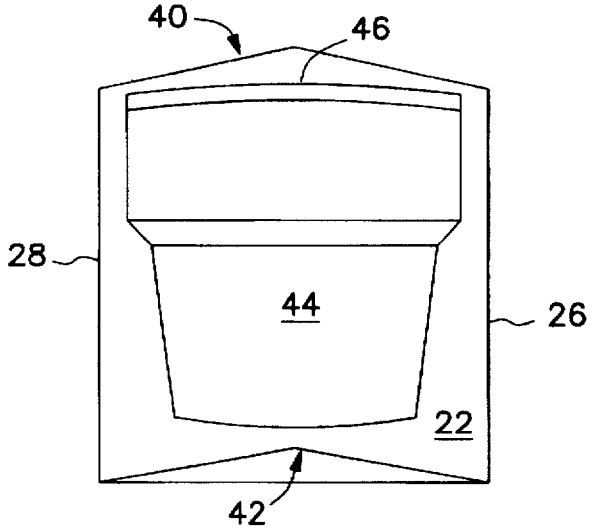
FIG. 3 is a sectional view taken along line 3—3 of FIG. 1 illustrating the projecting and recessed portions of the shipping container.

As illustrated in FIG. 3, a computer monitor 44 is placed within shipping container 20 with the monitor screen 46 facing toward top closure 40. Having screen 46 face top closure 40 which projects outward from shipping container 20 will inhibit an individual from placing the container with the screen side down. As will be evident to those skilled in the art, the terms top and bottom are used herein for convenience of description only. The intent of the invention is that container 20 may be set on any of opposed side panels 22, 24, 26 or 28 or on bottom end 32 but not on top end 30.

Figure 4:
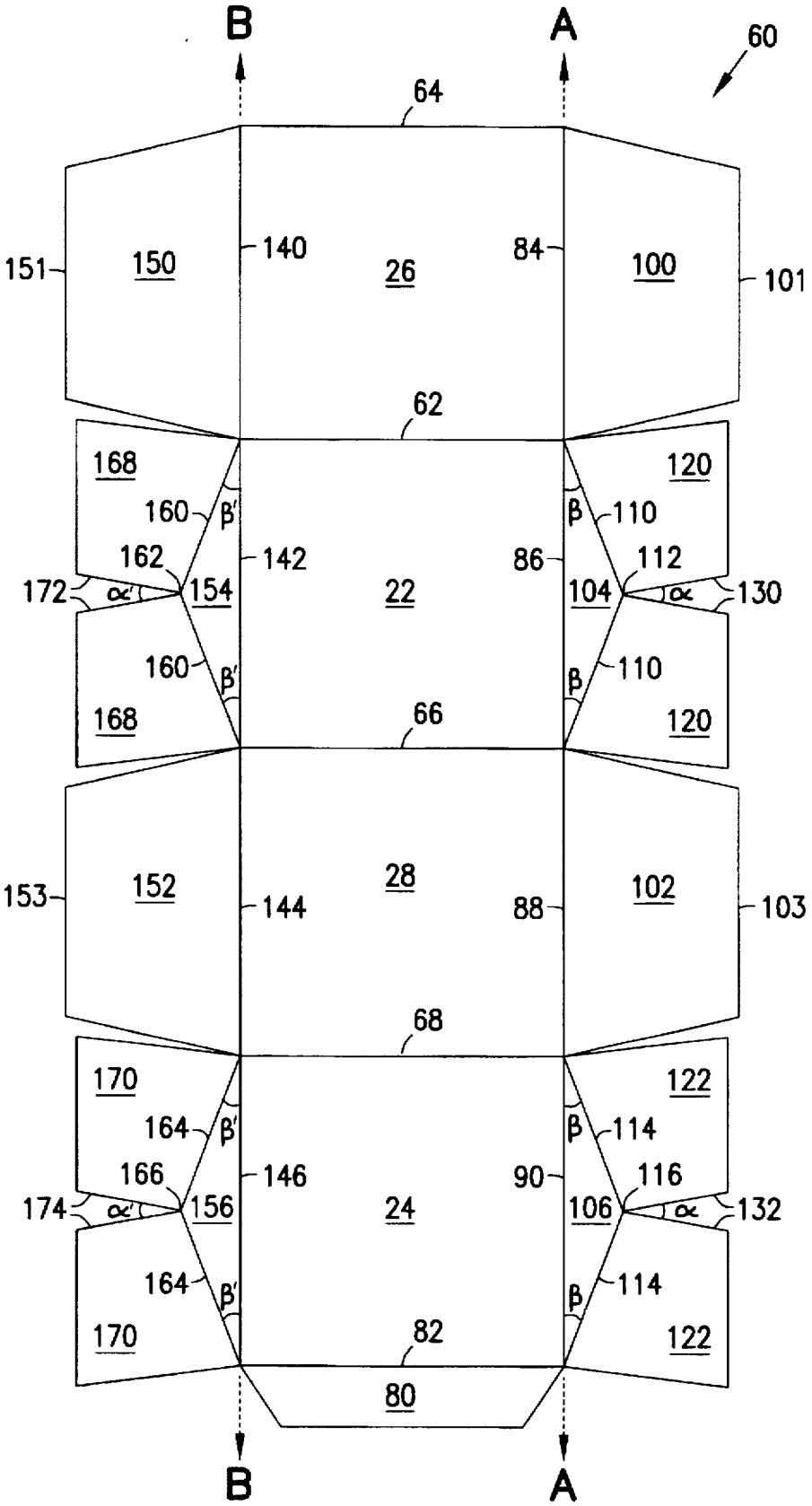
FIG. 4 is a plan view illustrating a material blank for making the shipping container shown in FIG. 1.

FIG. 4 illustrates a unitary die-cut material blank 60 which is used to construct shipping container 20 illustrated in FIGS. 1–3. Any number of materials may be used to construct container 20 without departing from the scope of the present invention. Materials such as corrugated paperboard or laminated paper or fiberboard are typically used to construct containers of this type.

Blank 60 includes opposed rectangular panels 22, 24, 26 and 28 arranged longitudinally along the blank. Panel 26 is hingedly attached along a fold line 62 to panel 22 and has a free edge 64 opposite fold line 62. Panel 22 is hingedly attached to panel 28 along a fold line 66 which is opposite fold line 62 and parallel thereto. Panel 28 is hingedly attached to panel 24 along a fold line 68 which is opposite fold line 66 and parallel thereto. Fold lines 62, 66 and 68 are preferably formed in blank 60 when it is produced to aid in bending blank 60 in order to construct shipping container 20.

A connecting flap 80 is hingedly attached to panel 24 along fold line 82 which is parallel to fold line 68. Flap 80 is used to adhere to panel 26 when container 20 is formed as will be described in more detail herein. A linear fold line shown as imaginary line "A" in FIG. 4 defines a top edge 84, 86, 88 and 90 for each of opposed panels 26, 22, 28 and 24, respectively, which correspond to and define top end 30 of container 20 when assembled. A portion of top closure 40 is defined by a pair of top closure panels 100 and 102. Top closure panel 100 is hingedly attached along top edge 84 to panel 26 and has a free edge 101 parallel to and opposite top edge 84. Top closure panel 102 is hingedly attached to panel 28 along top edge 88 and has a free edge 103 parallel to and opposite top edge 88.

Further defining top closure 40 are a pair of top gable panels 104 and 106. Top gable panel 104 is hingedly attached to panel 22 along top edge 86 and top gable panel 106 is hingedly attached to panel 24 along top edge 90. Each of top gable panels 104 and 106 is in the shape of a triangle having a base defined by top edge 86 and top edge 90, respectively. Top gable panel 104 has a pair of equal length sides 110 which terminate at an apex 112. Top gable panel 106 has a pair of equal length sides 114 which terminate at an apex 116.

An inner flap 120 is foldably attached to each of sides 110 of top gable panel 104 and an inner flap 122 is foldably attached to each of sides 114 of top gable panel 106. Inner flaps 120 and 122 provide a support surface for each of top closure panels 100 and 102 when shipping container 20 is assembled. Each inner flap 120 includes a ridge line edge 130 extending from apex 112 of top gable panel 104. Each inner flap 122 includes a ridge line edge 132 extending from apex 116 of top gable panel 106. Ridge line edges 130 extending from apex 112 diverge relative to one another at an angle α, as do ridge line edges 132 which extend from apex 116. Gable panel sides 110 and 114 extend from top edge 86 and 90, respectively, at an angle β relative to their adjacent top edge. The angles α and β may be selected to determine the desired top closure geometry as will be described in more detail herein.

A linear fold line shown as imaginary line "B" in FIG. 4 defines a bottom edge 140, 142, 144 and 146 for each of opposed side panels 26, 22, 28 and 24, respectively, which correspond to and define bottom end 32 of container 20 when assembled. A portion of bottom closure 42 is defined by a pair of bottom closure panels 150 and 152. Bottom closure panel 150 is hingedly attached along bottom edge 140 to panel 26 and has a free edge 151 which is parallel to and opposite bottom edge 140. Bottom closure panel 152 is hingedly attached to panel 28 along bottom edge 144 and has a free edge 153 which is parallel to and opposite bottom edge 144. Bottom closure panels 150 and 152 of the present embodiment are essentially of the same size and shape as top closure panels 100 and 102, except that slight differences may be desirable as will be described herein.

Further defining bottom closure 42 are a pair of bottom gable panels 154 and 156 with panel 154 hingedly attached along bottom edge 142 to side panel 22 and panel 156 hingedly attached along bottom edge 146 to side panel 24. Bottom gable panels are of essentially the same size and shape as top gable panels 104 and 106, except that slight differences may be desirable as will be described herein. Bottom gable panels 154 and 156 each include a base defined by bottom edges 142 and 146, respectively. Bottom gable panel 154 has a pair of sides 160 which terminate at an apex 162. Sides 160 extend from bottom edge 142 at an angle β' relative thereto. Bottom gable panel 156 has a pair of sides 164 which terminate at an apex 166 and sides 164 extend from bottom edge 146 at an angle β" relative thereto. Angle β' is similar to angle β' except that a slight difference may be desirable as is described herein.

An inner flap 168 is foldably attached along each of sides 160 to bottom gable panel 154 and an inner flap 170 is foldably attached to each of sides 164 of bottom gable panel 156. Inner flaps 168 and 170 are similar in size and shape to inner flaps 120 and and 122 and provide support for bottom closure panels 150 and 152 when shipping container 20 is assembled. Each of inner flaps 168 includes a ridge line edge 172 extending from apex 162 which diverge relative to one another at an angle α'. Each of inner flaps 170 has a ridge line edge 174 diverging relative to one another from apex 166 at an angle α'. Angle α' is similar to angle α but a slight difference may be desirable as will be described herein.

To construct shipping container 20 from blank 60, panel 26 is folded to a right angle relative to panel 22 along fold line 62, panel 28 is folded to a right angle along fold line 66 relative to panel 22 and panel 24 is folded to a right angle relative to panel 28 along fold line 68 such that fold line 82 abuts against free edge 64 of panel 26 forming a rectangular tube. Flap 80 is folded to a right angle relative to panel 24 along fold line 82 and overlaps panel 26 on the inside surface of the rectangular tube. Any suitable adhesive means such as glue, double sided adhesive tape, staples or the like which are well known in the art may be used to secure flap 80 to panel 26.

As will be evident to those skilled in the art, the assorted top panels defining top closure 40 and the bottom panels defining bottom closure 42 of shipping container 20 are essentially identical in form and construction. Therefore, either set of panels may be used to form either of projecting top closure 40 or recessed bottom closure 42. To simplify the description herein, the panels associated with the fold line defined by imaginary line "A" illustrated in FIG. 4 will be utilized in describing how to construct the protruding top closure 40. The panels associated with imaginary line "B" will be utilized to describe how to construct recessed bottom closure 42 of shipping container 20. As noted above, the angles α and β for top closure 40 are similar to but may differ slightly from α' and β' for bottom closure 42. To insure proper nesting of top closure 40 of one container 20 into bottom closure 42 of another container 20, bottom closure 42 may be recessed slightly deeper than the height of projecting top closure 40. Also, the top gable panels 104 and 106 of top closure 40 may be angled inward slightly more than bottom gable panels 154 and 156. As will be seen by those skilled in the art, the height of top closure 40 and depth of bottom closure 42 may be manipulated by altering the angles α, α', β and β.

Top closure 40 is formed by initially folding each of inner flaps 120 along each side 110 of top gable panel 104 inward relative to container 20 until the adjacent ridge line edges 130 extending from each apex 112 abut one another. Similarly, inner flaps 122 of top gable panel 106 are folded inward until the adjacent ridge line edges 132 abut one another. To hold inner flaps 120 in such a condition, adhesive means of any type suitable for such a shipping container may be used to retain ridge line edges 130 and 132 in their abutting condition.

The next step is to fold each gable panel 104 and 106 along each of top edges 86 and 90, respectively, slightly inward until abutting ridge line edges 130 of gable panel 104 and abutting ridge line edges 132 of gable panel 106 are co-linear and parallel to one another. It is preferred that top gable panels 104 and 106 are tapered or angle slightly inward relative to a plane defined by their adjacent panels 22 and 24 as illustrated in FIG. 1 when ridge lines 130 and 132 associated with the top gable panels are co-linear with one another. The angle α may be selected depending upon the desired inward taper of top gable panels 104 and 106 of shipping container 20. In the present embodiment, angle α is in the range of about 20° to 25°.

The next step in forming top closure 40 is to fold top closure panels 100 and 102 along top edges 84 and 88, respectively, inward relative to one another such that they rest on inner flaps 120 and 122. Top closure panels 100 and 102 may then be suitably taped, stapled or otherwise adhered in some suitable manner to inner flaps 120 and 122 forming protruding top closure 40 of shipping container 20.

Bottom closure 42 is intended to be recessed into container 20 beyond bottom end 32 but may be formed using the exact same panel configuration and construction as that to form protruding top closure 40. As will be seen to those skilled in the art, bottom closure 42 need not be of an identical shape and contour as top closure 40 but must merely be recessed enough to completely receive therein top closure 40 to properly nest a plurality of shipping containers 20. Bottom gable panels 154 and 156 may be tapered or angle inward slightly less than top gable panels 104 and 106 to facilitate proper and complete nesting. Therefore, in the present embodiment angle α' may be slightly larger than angle α. Bottom closure 42 may also be recessed slightly deeper than top closure 40 projects to further facilitate proper and complete nesting. Therefore angle β' may be slightly larger than angle β.

To construct bottom closure 42 of the present embodiment, the first step is to fold inner flaps 168 along sides 160 of bottom gable panel 154 outwardly relative to the rectangular tube defined by opposed side panels 22, 24, 26 and 28. Inner flaps 168 are folded until ridge line edges 172 extending from apex 162 abut one another. Similarly, inner flaps 170 are folded along sides 164 of bottom gable panel 156 outwardly relative to container 20 until ridge line edges 174 abut one another. Flaps 168 and 170 may be retained in place by any suitable adhesive means. Bottom gable panels 154 and 156 are then folded along bottom edges 142 and 146, respectively, into the rectangular tube of container 20 until abutting ridge line edges 172 of gable panel 154 are parallel to and co-linear with abutting ridge line edges 174 of gable panel 156, and recessed into bottom end 32 of container 20.

To complete bottom closure 42, bottom closure panels 150 and 152 are folded along bottom edges 140 and 144, respectively, until they are recessed inward relative to shipping container 20 and rest against inner flaps 168 and 170. Bottom closure panels 150 and 152 may then be retained in place by any suitable adhesive means such as adhesive tape, glue or staples.

One of top closure panels 100 or 102 may include an extra foldable flap extending along free edge 101 or 103, respectively which would overlap with the other top closure flap for use as an attachment flap. This flap could include an adhesive strip or simply be glued, taped or stapled to the other flap to secure top closure 40. One of bottom closure flaps 150 or 152 could also include such an attachment flap for securing bottom closure 42.

As illustrated in FIG. 3, a computer monitor 44 having a screen 46 may be placed within shipping container 20 prior to the top closure 40 being closed with the screen oriented to face the protruding top closure 40. The intent of the present invention is to inhibit one from placing the shipping container 20 onto top closure 40 to avoid having the screen 46 facing downward which could cause harm to the function of monitor 44. By including the protruding top closure, an individual will be aware, without having to read words or symbols on the exterior of the shipping container 20, that the box is improperly oriented because the box will not rest flat.

Figure 5:
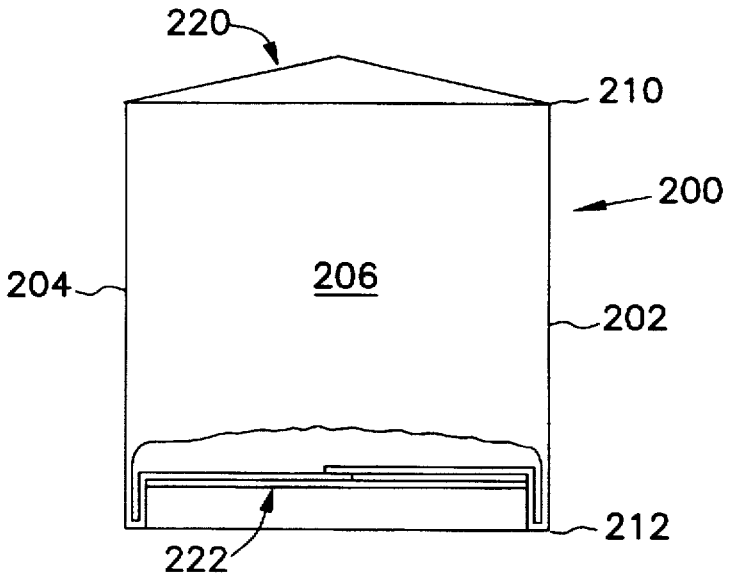
FIG. 5 is a partial fragmentary side view illustrating a shipping container constructed in accordance with another embodiment of the present invention.

FIG. 5 illustrates a shipping container 200 constructed in accordance with another embodiment of the present invention. Shipping container 200 includes a first pair of opposed side panels 202 and 204 and a second pair of opposed side panels 206 and 208 which together in combination define a rectangular tube having a top end 210 and a bottom end 212. Top end 210 is closed off by a top closure 220 which in the present embodiment is constructed and arranged exactly the same as top closure 40 of shipping container 20 in the prior embodiment. Bottom end 212 is closed off by a bottom closure 222 which is constructed and arranged according to another embodiment of the present invention and will be described herein.

Bottom closure 222 is generally a rectangular planar surface recessed within and generally parallel to bottom end 212 of container 200. The depth of the recess must be slightly larger than the height of projecting top closure 220 so that when a number of boxes are stacked together, a top closure 220 of one container 200 will completely and properly nest within an adjacent bottom closure 222 of another container. As previously noted, the top closure may take on any number of configurations and contours and still properly nest within bottom closure 222.

Figure 6:
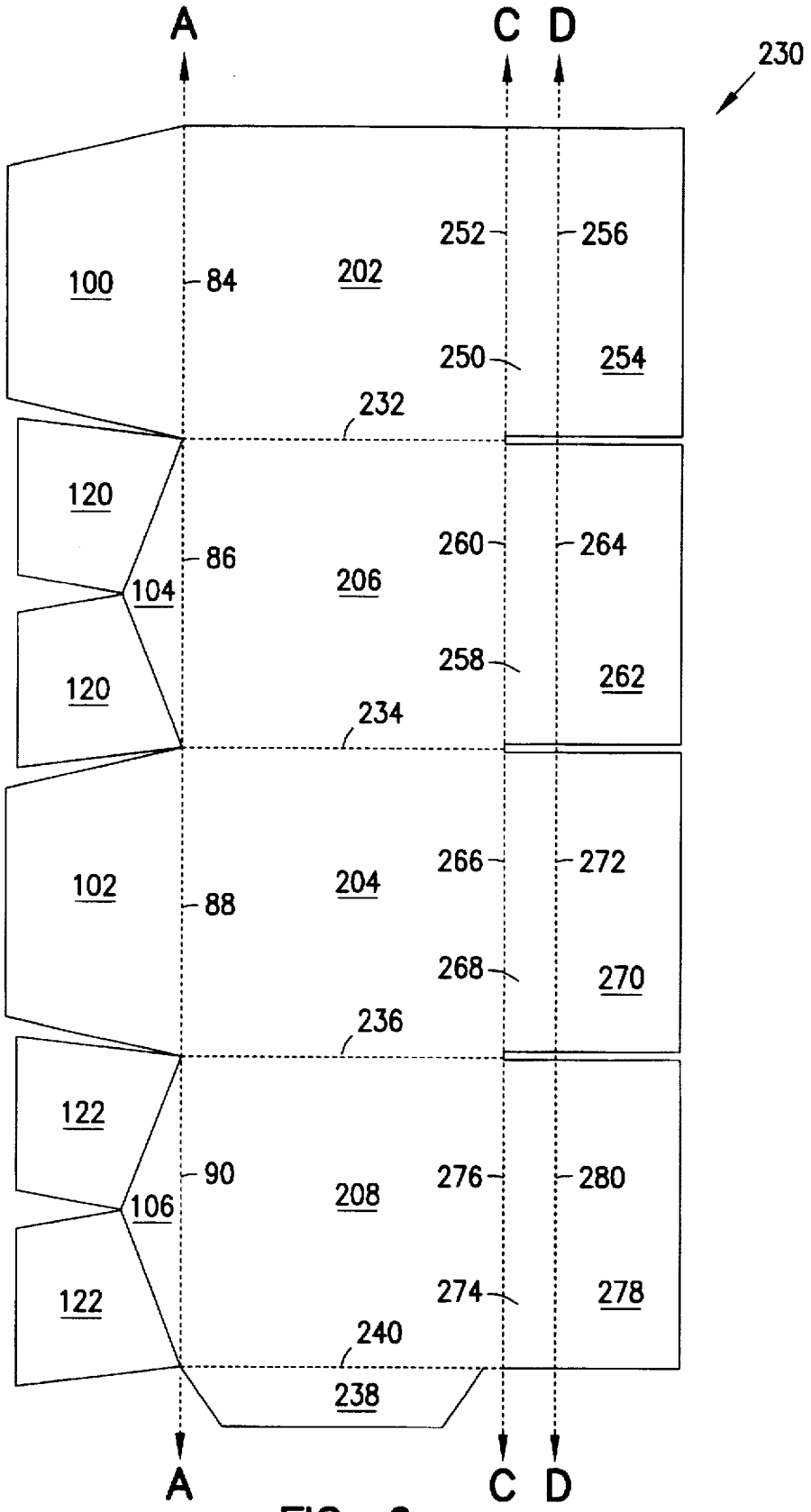
FIG. 6 is a plan view illustrating the material blank for making the shipping container of FIG. 5.

A one-piece material blank 230 for constructing an alternative shipping container 200 is illustrated in FIG. 6. Again, blank 230 may be constructed from any number of materials without departing from the scope of the present invention but is typically of a corrugated paperboard or the like. Opposed side panel 202 is hingedly attached to side panel 206 along a fold line 232, side panel 206 is hingedly attached to side panel 204 along a fold line 234 and side panel 208 is attached to side panel 204 along a fold line 236. A connecting flap 238 is hingedly attached to side panel 208 along a fold line 240. As in the prior embodiment, the side panels are folded along fold lines 232, 234 and 236 so that panels 202 and 204 oppose one another and panels 206 and 208 oppose one another and are perpendicular to panels 202 and 204. Connecting flap 238 is folded along fold line 240 to overlap the inside surface of side panel 202 and is secured thereto forming a rectangular tube.

Side panel 202 includes a foot panel 250 hingedly connected along a fold line 252 thereto. A rectangular bottom closure panel 254 is hingedly attached to foot panel 250 along a fold line 256. Side panel 206 similarly has a foot panel 258 attached along a fold line 260 and similarly has a bottom closure panel 262 attached to foot panel 258 along a fold line 264. Side panel 204 includes a foot panel 266 attached to it along a fold line 268 and a bottom closure panel 270 attached to foot panel 266 along a fold line 272. Side panel 208 includes a foot panel 274 attached thereto along a fold line 276 and a bottom closure panel 278 attached to foot panel 274 along a fold line 280.

Fold lines 252, 260, 268 and 276 are parallel and co-linear and are designated as imaginary line "C" in FIG. 6. Fold lines 256, 264, 272 and 280 are parallel and co-linear relative to one another and are designated as imaginary line "D" as illustrated in FIG. 6. The fold lines defined by imaginary lines "C" and "D" are preferably parallel to one another and spaced apart with the spacing defining the depth to which bottom closure 222 is recessed.

To construct bottom closure 222 of the embodiment illustrated in FIG. 5, opposed side panels 202, 206, 204 and 208 are folded in to a rectangular tube as described above. Each of foot panels 250, 258, 266 and 274 are then folded inwardly to the inside of the tube until they are overlapping and parallel with their respective side panels 202, 206, 204 and 208. Foot panels 250, 258, 266 and 274 may include an adhesive on their inside surface to adhere them to their respective side panels or may simply stapled or otherwise adhered thereto to retain them in position. Bottom closure panels 254, 262, 270 and 278 are then folded back away from and perpendicular to their respective side panels 202, 206, 204 and 208 such that they are parallel to and overlap one another. Bottom closure panels 254, 262, 270 and 278 may then be glued, taped, stapled or otherwise secured to retain them in their position.

The depth to which bottom closure 222 is recessed within bottom end 212 of container 200 is defined by the span across foot panels 250, 258, 266 and 274 between imaginary lines "C" and "D". The depth must be such that top closure 220 may be fully received therein to facilitate proper nesting of a plurality of shipping containers 200 when stacked together for shipping or storage.

Figure 7:
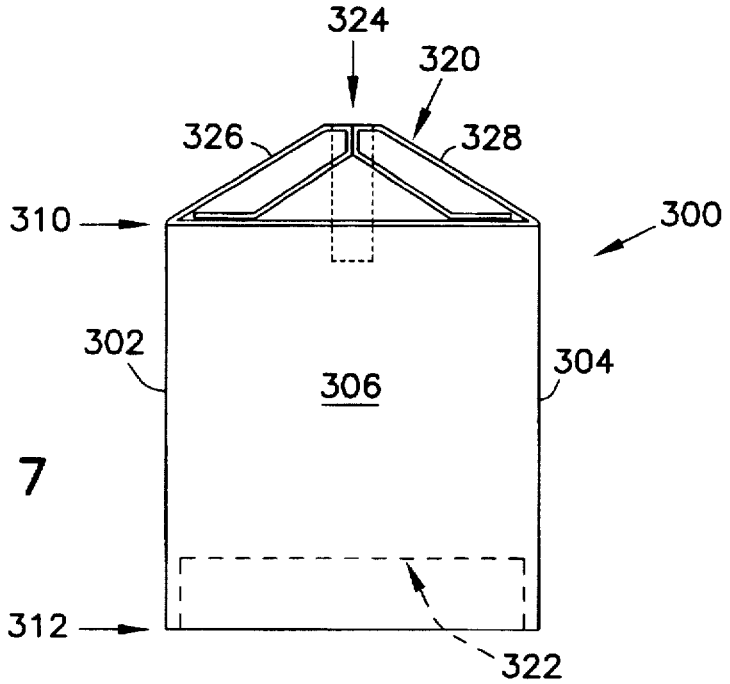
FIG. 7 is a side view illustrating a shipping container constructed in accordance with another embodiment of the invention including a crush resistant structure insert.

FIG. 7 and illustrates a shipping container 300 constructed in accordance with another embodiment of the present invention. Shipping container 300 includes a first pair of opposed side panels 302 and 304 parallel to one another and a second pair of opposed side panels 306 and 308 parallel to one another and perpendicular to side panels 302 and 304. Side panels 302, 304, 306 and 308 combine to form a rectangular tube having a top end 310 and a bottom end 312. Top end 310 is covered by a top closure 320 illustrating another embodiment of the invention. A bottom closure 322 covers bottom end 312, and in the embodiment disclosed in FIG. 7, is constructed identical to that disclosed in the prior embodiment of FIGS. 5 and 6. Bottom closure 322 of the present embodiment may be constructed having any number of contours and configurations without departing from the scope of the present invention as will be easily seen by those skilled in the art.

Figure 8:
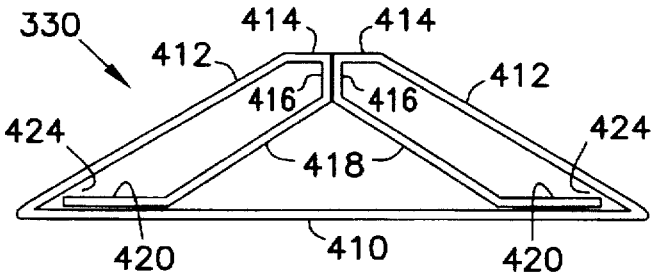
FIG. 8 is an end view illustrating the crush resistant structure insert of the shipping container of FIG. 7.
Figure 9:
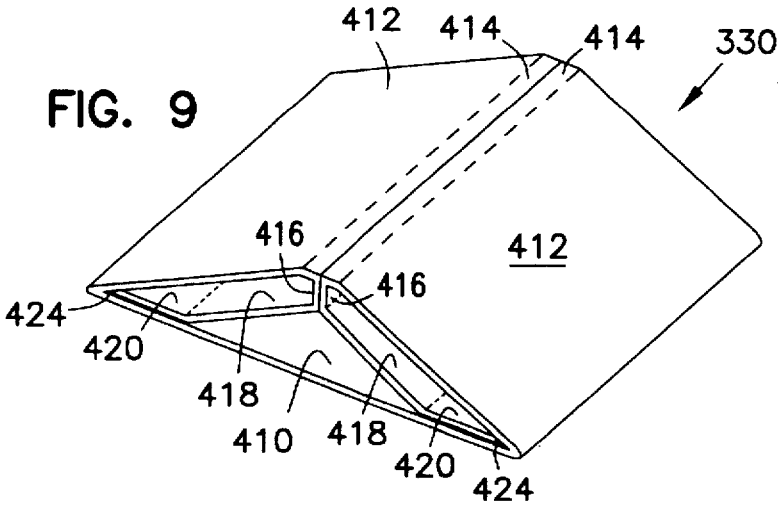
FIG. 9 is a perspective view illustrating crush resistant structure of FIG. 8.

Top closure 320 includes a horizontal portion parallel to and covering top end 310 and an upwardly extending portion generally in the shape of a gabled roof having a ridge line or peak 324. Top closure 320 has a pair of top panels 326 and 328 extending between top end 310 and peak 324 of container 300. A crush resistant structure 330 is received as a separate insert between top end 310 and top panels 326 (FIGS. 7, 8 and 9). Structure 330 has a generally triangular shape viewed in cross section following the contour of panels 326 and top end 310. Structure 330 also spans the length of peak 324 across top closure 320.

Figure 10:
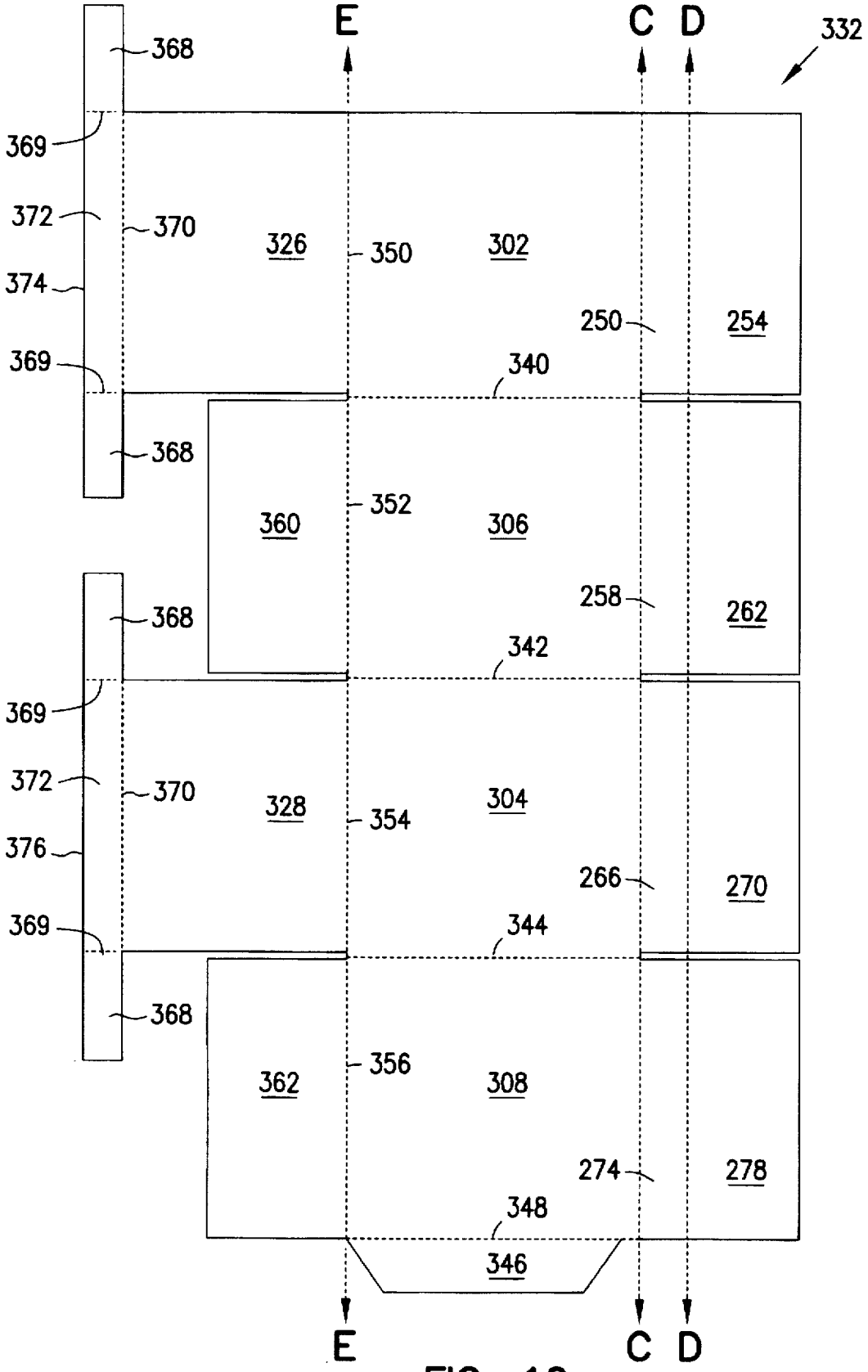
FIG. 10 is a plan view illustrating the material blank for making the shipping container of FIG. 7.

FIG. 10 illustrates a material blank 332 for constructing container 300. Blank 332 includes opposed side panels 302, 304, 306 and 308 hingedly attached along a number of parallel fold lines 340, 342 and 344. Blank 332 is folded along fold lines 340, 342 and 344 forming a rectangular tube similar to that described for the prior embodiments shown in FIGS. 1 and 5. A connecting flap 346 is hingedly attached to side panel 308 along a fold line 348 for adhering to the inner surface of panel 302. Each of side panels 302, 306, 304 and 308 has a fold line 350, 352, 354 and 356, respectively, illustrated by imaginary line "E" in FIG. 11 which combine to define top end 310. An inner closure flap 360 is hingedly attached along fold line 352 to panel 306 and an inner closure flap 362 is hingedly attached along fold line 356 to opposed panel 308 for forming the horizontal portion of top closure 320 on top end 310 of shipping container 300.

Top panel 326 is hingedly connected to side panel 302 along fold line 350 and top panel 328 is hingedly connected to opposed side panel 304 along fold line 354 for forming the outwardly extending portion of top closure 320. Top panels 326 and 328 each may include a pair of closure tabs 368 each hingedly attached along a fold line 369 to and extending outwardly from panels 326 and 328 essentially parallel to imaginary line "E". Closure tabs 368 are for securing top panels 326 and 328 when top closure 320 is constructed.

After a rectangular tube is constructed from opposed side panels 302, 304, 306 and 308 and bottom closure 322 is constructed just as described for the embodiment of FIG. 6, top closure 320 may be constructed. Inner flaps 360 and 362 are folded along fold lines 352 and 356, respectively, toward one another until they overlap and are parallel to one another. Inner flaps 360 and 362 may be suitably stapled, taped or otherwise adhered together to retain them in position essentially parallel to top end 310 of shipping container 300. Crush resistant structure 330 is then placed on inner flaps 360 and 362. Closure panels 326 and 328 are then folded along fold lines 350 and 354, respectively, inwardly toward one another over structure 330. Tabs 368 are then folded downwardly parallel to and overlapping panels 306 and 308 and may be adhered thereto by any suitable means. Tabs 368 act to retain structure 330 within top closure 320 and to secure top panels 326 and 328 in place.

As will be evident to those skilled in the art, a fold line 370 may be included on each of top panels 326 and 328 corresponding to the width of tabs 368. A horizontal or flat top seam 372 may then be formed on each of top panels 326 and 328 between fold lines 370 and a free edge 374 and 376 of panels 326 and 328, respectively. Top panels 326 and 328 may be of such a length that their free edges 374 and 376, respectively, either abut against one another or overlap one another according to the width of top seam 372 defined by fold lines 370. If top seam 372 of one of top panels 326 or 328 overlaps the other, tabs 368 may be removed or eliminated from the overlapped closure panel. They would not be necessary for securing top panels 326 and 328 to shipping container 300. Also, adhesive may be applied to secure the overlapping top panels or tape or staples may otherwise be used to secure top panels 326 and 328 in place.

Figure 11:
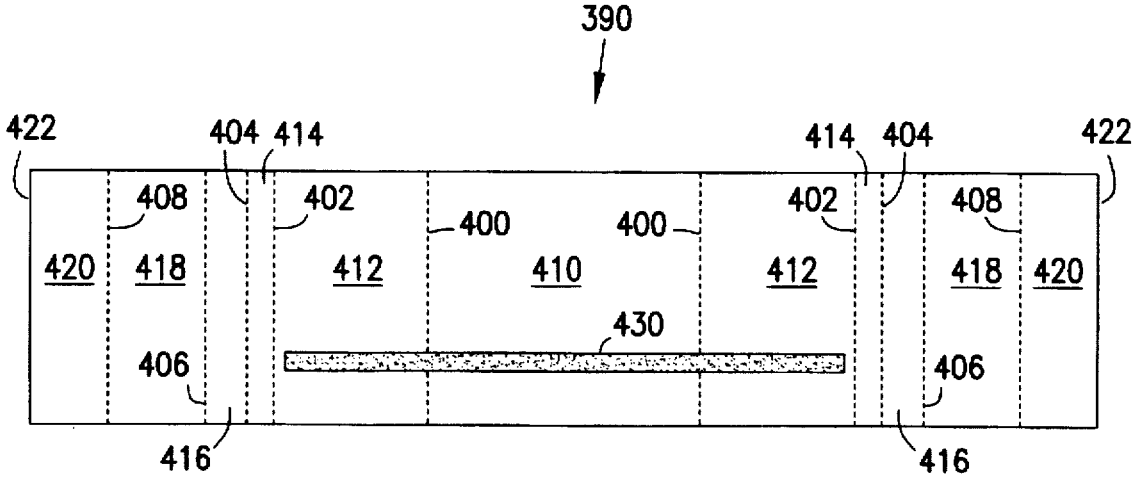
FIG. 11 is a plan view illustrating the material blank for making the crush resistant structure insert of FIG. 8.

FIG. 11 illustrates a material blank 390 for constructing crush resistant structure 330. Structure 330 is formed from a long thin strip of semi-rigid material such as corrugated paperboard or the like, having a number of symmetrically corresponding pairs of fold lines 400, 402, 404, 406 and 408. The width of material blank 390 is preferably substantially the same as the width of side panels 302 and 304 of container 300 defined along fold lines 350 and 354, respectively, so that when structure 330 is placed on inner flaps 360 and 362, it essentially spans the width of the container.

A base member 410 is defined by the area between fold lines 400 on blank 390. An outer wall 412 is defined by the area between each of fold lines 400 and 402 on blank 390. A top wall 414 is defined by the area between each of fold lines 402 and 404 on blank 390. A depending wall 416 is defined by the area between each of fold lines 404 and 406 on blank 390. A load-bearing wall 418 is defined by the area between each of fold lines 406 and 408 on blank 390. A foot member 420 is defined by the area between each of fold lines 408 and a free end 422 of blank 390.

To fabricate structure 330, foot members 420 are folded along fold lines 408 upward relative to blank 390. Load-bearing walls 418 are then folded along fold lines 406 upward in the same direction as foot members 420. Depending walls 416 are folded upward along fold lines 404 until essentially perpendicular to top walls 414. Top walls 414 are also folded slightly upward along fold lines 402 such that load bearing walls 418 are spaced from and generally parallel to outer walls 412. Outer walls 412 are then folded along fold lines 400 in the same upward direction relative to base member 410 until they are converging relative to one another. A closed end 424 is defined at each joint between outer walls 412 and base member 410 along fold lines 400 when the outer walls are folded toward one another. When structure 330 is completed, foot members 420 are parallel to and abut base member 410 with each free end 422 extending into its respective closed end 424. Depending walls 416 abut parallel to one another and top walls 414 are parallel and co-planar with one another.

To retain crush resistant structure 330 in its assembled condition, adhesive tape of suitable strength may be applied along the seam defined by abutting top walls 414 and/or perpendicularly over the seam from one of outer walls 412 to the other. Any number of securing means may be utilized without departing from the scope of the present invention.

To further provide strength for crush resistant structure 330, a tension member 430 may be added following along a portion of the inner contour of the structure. One or more tension members 430 may be situated such that they extend along base member 410 and are pinched between each of free ends 420 and closed ends 422 and extend upward along the inside surface of outer walls 412. Tension members 430 may be secured at each end or over their entire length to material blank 390 prior to forming structure 330. Tension members 430 may terminate any where along blank 390 along outer walls 412, or along the inside surface of top walls 414, depending walls 416, load-bearing walls 418 or even foot members 420.

Tension members 430 may be produced from a variety of relatively nonelastic materials having high tensile strength such as thermoplastic or nylon shipping straps or reinforced shipping tape. Alternatively, blank 390 may be produced from a paperboard laminate material wherein the layered or laminate structure provides increased strength to structure 330. As will be evident to those skilled in the art, tension member 430 may take on a variety of constructions and configurations without departing from the scope of the present invention.

As a load is applied to top walls 414 as illustrated in FIG. 9, outer walls 412 flex toward one another and pivot about closed ends 424. Structure 330 compresses upon application of force such that the load is transmitted through depending walls 416 to load-bearing walls 418 and then through foot members 420 into closed ends 424. Without tension members 430, adhesive may be applied between abutting depending walls 416 and also between base member 410 and foot members 420 such that most of the load is carried by load-bearing walls 418. If no adhesive is applied between base member 410 and foot members 420, the one or more tension members 430 will act to bear some of the load. Foot members 420 will be forced outward into closed ends 424 and hence apply tensile force to each tension member 430 as it is pinched in the closed ends.

Figure 12:
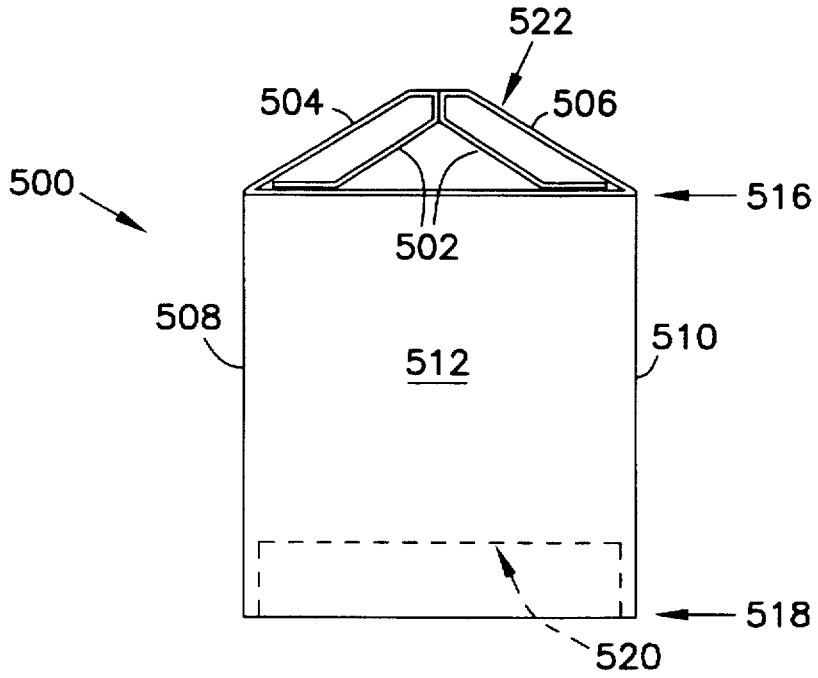
FIG. 12 is a side view illustrating a shipping container constructed in accordance with another embodiment of the invention including an integral crush resistant structure.

As will be evident to those skilled in the art, a crush resistant structure may also be formed integral with the top closure panels of a shipping container. FIG. 12 illustrates a shipping container 500 having structure 502 formed integral with each of a pair of top panels 504 and 506. Container 500 is essentially the same shape as container 300, the only difference being in the formation of the crush resistant structure. Shipping container 500 has a first pair of opposed and parallel side panels 508 and 510 and a second pair of opposed and parallel side panels 512 and 514 which are perpendicular to side panels 508 and 510. Container 500 has a top end 516 and a bottom end 518. A bottom closure 520 covers bottom end 518 and may take on any number of constructions and configurations without departing from the scope of the present invention.

Figure 13:
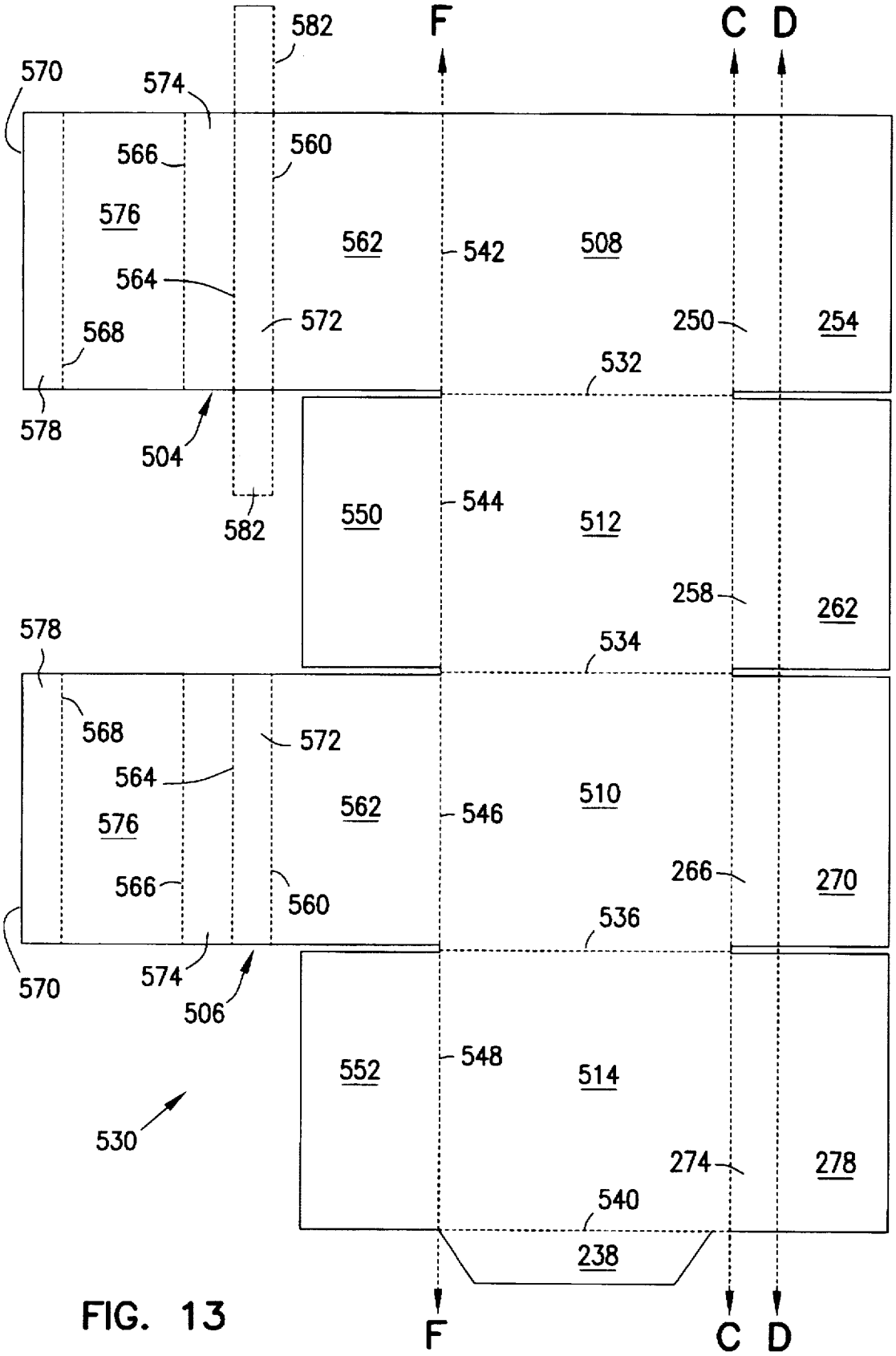
FIG. 13 is a plan view illustrating the material blank for making the shipping container of FIG. 12.

A top closure 522 covers top end 516 and includes top panels 504 and 506 and crush resistant structures 502. Top closure 522 also has a horizontal portion covering top end 516. FIG. 13 illustrates a material blank 530 for fabricating shipping container 500.

Blank 530 includes side panels 508, 510, 512 and 514 hingedly attached along parallel fold lines 532, 534 and 536. A connection tab 538 is hingedly attached along a fold line 540 to side panel 514. Side panels 508, 510, 512 and 514 are folded about fold lines 532, 534 and 536 into a rectangular tube. Tab 538 is folded along fold line 540 to overlap and adhere to the inside surface of panel 508 securing the side panels in the tube configuration. A number of co-linear fold lines 542, 544, 546 and 548 illustrated as imaginary line "F" in FIG. 13 are formed adjacent the top edge of each side panel 508, 512, 510 and 514, respectively, and combine to define top end 516 of container 500.

An inner closure flap 550 is hingedly attached along fold line 544 to side panel 512 and an inner closure flap 552 is hingedly attached along fold line 548 to panel 514. Closure flaps 550 and 552 are folded inwardly toward one another and overlap to define the horizontal portion of top closure 522 parallel to and co-planar with top end 516. Top panels 504 and 506 are hingedly attached along fold line 542 to panel 508 and fold line 546 to panel 510, respectively, and are each constructed to form a crush resistant structure 502 of the present embodiment.

Each of top panels 504 and 506 includes a fold line 560 defining an outer wall 562 between fold line 560 and fold line 542 of panel 508 and line 546 of panel 510. Each top panel 504 and 506 also includes a fold line 564, fold line 566, fold line 568 and a free edge 570 which are all essentially parallel to one another and to fold lines 560. A top wall 572 is defined between fold line 560 and fold line 564 on each top panel 504 an 506. A depending wall 574 is defined between each of fold lines 564 and 566 on each top panel 504 and 506. A load-bearing wall 576 is defined between each of fold lines 566 and 568 on each top panel and a foot member 578 is defined between each of fold lines 568 and free edges 570 on each top panel 504 and 506. Each of crush resistant structures 502 is of essentially the same construction as each outer wall 412, top wall 414, depending wall 416, load-bearing wall 418 and foot member 420 of structure 330 described previously. Since each outer wall 562 is hingedly attached to container 500, there is no equivalent for base member 410 of structure 330 in the present embodiment. Each structure 502 is constructed in the same manner as each end of structure 330 except that foot members 578 terminate in closed ends 580. Each closed end 580 is defined by outer wall 562, its adjacent fold line 542 or 546, and inner flaps 550 and 552 which substitute for base member 410 of structure 330.

To secure top panels 504 and 506 in position, a pair of securing tabs 582 may be added extending from the top panels adjacent and parallel with each end of top walls 572. Such tabs 582 are shown in FIG. 13 in phantom view extending from top panel 504 merely to illustrate such a construction. The tabs 582 are intended to be similar in construction and use to tabs 368 of container 300.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A one-piece blank of foldable sheet material for forming a shipping container for holding an article of manufacture therein, said blank comprising;

a generally rectangular strip having a top side, a bottom side, and a free end, three parallel fold lines formed perpendicularly to said top and bottom sides, a closure tab disposed opposite said free end, a fourth fold line formed parallel with said three parallel fold lines and adjacent said closure tab, a top linear fold line along said top side of said blank, a bottom linear fold line along said bottom side of said blank, a first pair of side panels and a second pair of side panels alternating along said strip and defined by said linear fold lines along said top and said bottom sides of said blank, said parallel fold lines and said free end, a pair of top closure panels hingedly attached along said top linear fold line to each of said first pair of side panels, a pair of bottom closure panels hingedly attached along said bottom linear fold line to each of said first pair of side panels, a pair of top gable panels hingedly attached along said top linear fold line to each of said second pair of side panels, and a pair of bottom gable panels hingedly attached along said bottom linear fold line to each of said second pair of side panels.

2. The blank of foldable sheet material as recited in claim 1, wherein a plurality of gable panels each has the shape of a triangle.

3. The blank of foldable sheet material as recited in claim 1, further comprising an inner flap foldably attached to each side of at least one of the top gable panels.

4. The blank of foldable sheet material as recited in claim 3, wherein each inner flap includes a ridge line edge extending from an apex at a top of the gable panel, where each ridge line edge extending from the apex of the gable panel diverges relative to one another at an angle $\alpha$.

* * * * *